US006689236B1

(12) United States Patent
Taylor et al.

(10) Patent No.: US 6,689,236 B1
(45) Date of Patent: Feb. 10, 2004

(54) BINDER MATRIX FOR GAS GENERANTS AND RELATED COMPOSITIONS AND METHODS

(75) Inventors: Robert D. Taylor, Hyrum, UT (US); Gregory B. Hess, Hyrum, UT (US); Gary L. Smith, Layton, UT (US)

(73) Assignee: Autoliv ASP, Inc., Ogden, UT (US)

( * ) Notice: Subject to any disclaimer, the term of this patent is extended or adjusted under 35 U.S.C. 154(b) by 0 days.

(21) Appl. No.: 10/393,126

(22) Filed: Mar. 20, 2003

(51) Int. Cl.[7] ..... C06B 45/10

(52) U.S. Cl. ..... 149/19.7; 149/19.1; 280/741; 523/180

(58) Field of Search ..... 149/19.1, 19.7; 280/741; 523/180

(56) References Cited

U.S. PATENT DOCUMENTS

| | | | | | |
|---|---|---|---|---|---|
| 3,214,305 | A | | 10/1965 | Bowman et al. | |
| 3,904,674 | A | * | 9/1975 | Frankel et al. | 149/88 |
| 3,923,564 | A | * | 12/1975 | Lantz | 149/19.8 |
| 4,291,171 | A | | 9/1981 | Baum et al. | |
| 4,400,479 | A | * | 8/1983 | Bos | 524/38 |
| 4,804,693 | A | * | 2/1989 | Harvey et al. | 523/219 |
| 4,929,291 | A | | 5/1990 | Barnes | |
| 5,126,424 | A | * | 6/1992 | Brindopke et al. | 528/45 |
| 5,695,216 | A | | 12/1997 | Sandstrom et al. | |
| 5,844,165 | A | * | 12/1998 | Canterberry et al. | 149/19.5 |
| 5,852,120 | A | * | 12/1998 | Bederke et al. | 525/124 |
| 5,913,537 | A | | 6/1999 | Goetz | |
| RE36,296 | E | | 9/1999 | Zeigler | |
| 6,059,906 | A | | 5/2000 | Fleming et al. | |
| 6,120,058 | A | | 9/2000 | Mangum et al. | |
| 6,142,518 | A | | 11/2000 | Butt et al. | |
| 6,170,868 | B1 | | 1/2001 | Butt et al. | |
| 6,214,137 | B1 | | 4/2001 | Lee et al. | |
| 6,230,452 | B1 | * | 5/2001 | Gaveske | 523/177 |
| 6,368,431 | B1 | | 4/2002 | Mangum et al. | |

* cited by examiner

*Primary Examiner*—Edward A. Miller
(74) *Attorney, Agent, or Firm*—James D. Erickson; Sally J. Brown

(57) ABSTRACT

A binder matrix suitable for use in a gas generant composition, a gas generant composition including the binder matrix, and a related method of igniting such a gas generant composition are provided. The binder matrix includes a non-energetic binder material and dimethyl malonate non-energetic plasticizer and has a softening temperature above at least about 125° C. A gas generant composition including the binder matrix includes a non-energetic binder material such as cellulose acetate, dimethyl malonate non-energetic plasticizer, a fuel such as a nitramine fuel such as RDX, HMX or a combination thereof, and a stabilizer such as N-methyl-p-nitroaniline.

21 Claims, No Drawings

BINDER MATRIX FOR GAS GENERANTS AND RELATED COMPOSITIONS AND METHODS

BACKGROUND OF THE INVENTION

This invention relates generally to a binder matrix for a gas generant composition such as those used for the inflation of inflatable devices like airbag cushions included in inflatable restraint systems for automobile passengers. In particular, the invention relates to a binder matrix, including a non-energetic binder material and a non-energetic plasticizer, that has a softening temperature above at least about 125° C.

It is well know to protect a vehicle occupant using a cushion or bag, e.g., an "airbag cushion" that is inflated or expanded with a gas when a vehicle experiences sudden deceleration, such as in the event of a collision. Such airbag restraint systems normally include: one or more airbag cushions, housed in an uninflated and folded condition to minimize space requirements; one or more crash sensors mounted on or to the frame or body of the vehicle to detect sudden deceleration of the vehicle; an activation system electronically triggered by the crash sensors; and an inflator device that produces or supplies a gas to inflate the airbag cushion. In the event of a sudden deceleration of the vehicle, the crash sensors trigger the activation system which in turn triggers the inflator device which begins to inflate the airbag cushion in a matter of milliseconds.

Many types of inflator devices have been disclosed in the art for inflating one or more inflatable restraint system airbag cushions. Inflator devices which form or produce inflation gas via the combustion of a gas generating material, e.g., a "gas generant", are well known. One such inflator device, generally known as a hybrid gas generator, uses the high temperature combustion products, including additional gas products, generated by the burning of the gas generant to supplement stored and pressurized gas to inflate one or more airbag cushions are known. Often the stored and pressurized gas includes an oxidizing gas to assist in converting the reaction products generated by the combustion of the gas generant to less hazardous compounds such as carbon dioxide, water and nitrogen gases.

One type of gas generant that may be used in such hybrid gas generators is a low vulnerability ammunition propellant, also known as a LOVA-type gas generant. Originally developed as a safer propellant for military ammunition, LOVA-type gas generants have found use in inflator devices for airbag cushions because of their high burning rates and fast ignition reaction times. Such LOVA-type gas generant compositions, typically in the form of extrudlets or pellets, generally include a binder material, a plasticizer and high explosive such as, for example, cyclotrimethylenetrinitramine (RDX). The binder material, as well as the plasticizer, may be an energetic or non-energetic material. For example, U.S. Pat. No. 6,170,868 to Butt et al., herein incorporated by reference, discloses a LOVA-type gas generant composition including a nitramine explosive such as RDX, a non-energetic binder material such as a cellulose derivative, and either an energetic plasticizer or acetyl triethyl citrate non-energetic plasticizer.

Unfortunately, for some gas generant compositions such as certain LOVA-type gas generant compositions, particularly those including cellulose acetate butyrate as a binder material, the binder softening temperature is very near the required aging temperatures for gas generants used in automotive inflator devices. Additionally, the binder softening temperature can be further reduced by the addition of the plasticizer. The lower softening temperature of the binder material can cause the surface of the gas generant extrudlets or pellets to soften and become tacky which can cause the extrudlets or pellets to stick together resulting in a change in the ballistic response of the of the inflator device, sometimes by as much as 30 to 40 percent, due to the change in the surface area of the gas generant. This sticking phenomena is most evident after exposure to temperature cycling, aging and thermal shock environments such as those that an inflator device may be exposed to during an automobile's lifetime. Thus, the performance of such an inflator device becomes a function of the environment that each automobile would experience and, thus, less predictable. In some extreme cases where an automobile may be exposed to a relatively severe environment, the inflator devices may fail to protect an occupant in the event of a collision.

The sticking phenomena may be alleviated by blending or coating the extrudlets or pellets of the gas generant with a powdered additive, such as graphite, silica, or hydrophobic fumed silica so that the extrudlets or pellets do not physically touch during the application of thermal stimuli such as temperature fluctuations. However, this type of treatment increases the number of operations needed to manufacture the gas generant composition and hence increases the costs of manufacture.

Thus there is a need and a demand for a binder matrix that has a higher softening temperature. In particular, there is a need or a demand for a gas generant composition in pellet-form that has a reduced propensity to soften and stick together. There is a further need and a demand for a gas generant composition that is cost effective to prepare.

SUMMARY OF THE INVENTION

A general object of the invention is to provide an improved binder matrix for use in a gas generant composition.

A particular object of the invention is to provide a binder matrix having a higher softening temperature.

A more specific objective of the invention is to overcome one or more of the problems described above.

The general object of the invention can be attained, at least in part, through providing a binder matrix having a softening temperature above at least about 125° C. that includes a non-energetic binder material and a non-energetic plasticizer, wherein the non-energetic plasticizer is dimethyl malonate.

The prior art has generally failed to provide a binder matrix that is as effective as desired in satisfying one or more of the above-identified performance criteria. Furthermore, the prior art has generally failed to address the sticking phenomena that may occur in gas generant compositions such as LOVA-type gas generant compositions that include non-energetic binder materials having relatively low softening temperatures, particularly, cellulose acetate butyrate, and a plasticizer that further lowers the softening temperature of the binder material. Additionally, the prior art has generally failed to identify dimethyl malonate as a particularly compatible non-energetic plasticizer that may be used in combination with a non-energetic binder material to alleviate one or more of the above-identified performance inhibiting phenomena.

The invention further comprehends a gas generant composition including a binder matrix having a softening temperature above at least about 125° C., a fuel and a stabilizer.

The binder matrix includes about 8 to about 15 composition weight percent of a non-energetic binder material such as cellulose acetate and about 5 to about 12 composition weight percent dimethyl malonate plasticizer. The gas generant composition further includes about 70 to about 85 composition weight percent of a fuel such as a nitramine fuel and about 0.2 to about 0.5 composition weight percent of a stabilizer such as N-methyl-p-nitroaniline.

The invention still further comprehends a method for inflating an airbag cushion of an inflatable restraint system of a motor vehicle. The method includes igniting a gas generant composition to produce a quantity of inflation gas and inflating the airbag cushion with the inflation gas. The gas generant composition includes a fuel, a stabilizer, and a binder matrix having a softening temperature above at least about 125° C. The binder matrix includes a non-energetic binder material and dimethyl malonate plasticizer.

Reference herein to a "binder" or a "binder material" is to be understood to refers to a material or substance that creates uniform consistency, solidification, or cohesion of individual components such as the compounds included in a gas generant composition.

Reference herein to a "plasticizer" is to be understood to refer to a material or substance that may be added to a binder material to make the binder material flexible and/or extrudable.

Reference herein to an "equivalence ratio" is to be understood to refer to the ratio calculated by dividing the number of moles of oxygen present in a gas generant composition by the number of moles necessary to fully oxidize all carbon combustion products to carbon dioxide and all hydrogen combustion products to water.

Other objects and advantages will be apparent to those skilled in the art from the following detailed description taken in conjunction with the appended claims.

DETAILED DESCRIPTION OF THE INVENTION

The present invention provides a binder matrix such as for a gas generant composition, such as a LOVA-type gas generant composition, used in the inflation of inflatable devices such as vehicle occupant restraint airbag cushions. Such binder matrix typically has a softening temperature above at least about 125° C. and includes a non-energetic binder material and dimethyl malonate non-energetic plasticizer.

It is generally desirable in the production of gas generant compositions to include a binder matrix that is extrudable. Typically, such binder matrices include a binder material and a plasticizer that allow the gas generant composition to be extruded and formed into pellets. However, it has been found that for some binder matrices used in the production of gas generant compositions, particularly LOVA-type gas generant compositions, the softening temperature is at or very near the industry standard for long-term storage (e.g., 107° C. for 400 hours) of gas generant compositions utilized in inflator devices for airbag cushions. As a result, extrudlets or pellets of the gas generant composition may undesirably stick or adhere to each other causing a reduction in the ballistic response of the inflator device. This effect is particularly noted with binder compositions that include non-energetic binder materials such as cellulose derivatives and non-energetic plasticizers. It is believed that the effect occurs in these types of binder matrices because the binder material has a relatively low softening temperature which is further lowered by the addition of the plasticizer. Thus, it is desirable that the binder matrix include a non-energetic plasticizer that is compatible with the non-energetic binder material and does not lower the softening point of the matrix below about 125° C. One such compatible non-energetic plasticizer is dimethyl malonate. While it is generally known to utilize a compatible non-energetic plasticizer with a non-energetic binder material such as a cellulose derivative, heretofore, the use of dimethyl malonate non-energetic plasticizer as a component of a binder matrix to inhibit sticking or adherence of gas generant pellets has not been explored. The use of dimethyl malonate is desirable because it effectively plasticizes binder materials such as cellulose derivatives to make binder material extrudable while providing stability to the binder matrix by maintaining the matrix softening temperature above at least about 125° C. Additionally, of the compatible non-energetic plasticizers, dimethyl malonate is one of the few compounds that has a high enough oxygen content to provide effective combustion of fuels typically used in LOVA-type gas generant compositions.

In accordance with certain preferred embodiments of the invention, the binder matrix has a softening temperature above at least about 125° C. In particular, the binder matrix includes a non-energetic binder material in combination with dimethyl malonate non-energetic plasticizer.

Examples of non-energetic binders include cellulose acetate, cellulose acetate butyrate, ethyl cellulose, as well as, elastomeric binders such as polyurethanes, polysilicones, gum rubbers of polybutadiene or polyisoprene, butyl rubbers and polybutadienes containing hydroxy or carboxy functionality. One particularly suitable non-energetic binder material for use in the present invention is cellulose acetate because of its good oxygen combustion balance.

Generally, the binder matrices of the invention may advantageously include about 35 to about 45 matrix weight percent non-energetic binder material and about 55 to about 65 matrix weight percent dimethyl malonate non-energetic plasticizer. Practice of the invention utilizing the inclusion of dimethyl malonate within such range has been found to generally result or provide a binder matrix having a softening temperature above at least about 125° C. In one particular embodiment, the binder matrices of the invention may advantageously include about 35 to about 45 matrix weight percent cellulose acetate and about 55 to about 65 matrix weight percent dimethyl malonate.

In another aspect, the binder matrices of the invention may be included in a gas generant composition. Generally, such gas generant compositions may include a binder matrix having a softening temperature above at least about 125° C. and including a non-energetic binder material and dimethyl malonate, a fuel, and a stabilizer.

Generally, the gas generant composition of the invention may advantageously include about 8 to about 15 composition weight percent non-energetic binder material and about 5 to about 12 composition weight percent dimethyl malonate. In one particularly preferred embodiment in accordance with the invention, the gas generant composition includes about 8 to about 15 composition weight percent cellulose acetate and about 5 to about 12 composition weight dimethyl malonate.

While various fuel materials may be used in the gas generant compositions of the invention, in accordance with certain preferred embodiments, the fuel may advantageously be a nitramine fuel. Such nitramine fuels are generally nitrated organic compounds that include an internal oxidizer that promotes combustion and thus may be utilized in a gas generant composition without the addition of a separate oxidizing compound. Examples of suitable nitramine fuels include cyclotrimethylenetrinitramine (RDX), cyclotetramethylenetetranitramine (HMX), and combinations thereof.

In practice, the gas generant composition in accordance with the invention contains such fuel in a relative amount of between about 70 and about 85 composition weight percent.

The gas generant composition in accordance with the invention also includes a stabilizer to preclude oxidation of the binder matrix by atmospheric oxygen or decomposition products such as produced by or resulting from heating or aging the composition at temperatures exceeding typical ambient temperatures. Useful stabilizers that may be used in the gas generant composition include amines such as diphenylamine, 2-nitrodiphenylamine, and N-methyl-p-nitroaniline; urethanes such as 1,3-bis(N-methyl-phenyl urethane)benzene; phenols such as resorcinol; ureas such as diethylphenyl urea; and mixtures thereof. In one particular embodiment the gas generant composition may include N-methyl-p-nitroaniline.

In practice, the gas generant composition in accordance with the invention contains such stabilizer in a relative amount of between about 0.2 and about 0.5 composition weight percent.

As previously discussed, nitramine fuels typically include an internal oxidizer to facilitate combustion. However, the level of internal oxidizer in such nitramine fuels may not be sufficient to completely combust the fuel. Therefore, if desired, a gas generant composition in accordance with the invention may advantageously contain or include an oxidizer to raise the equivalence ratio to promote combustion or to increase the burning rate. Suitable oxidizers include alkali or alkaline earth metal nitrates, chlorates, and perchlorates; ammonium nitrate or perchlorate; transition metal oxides; and mixtures thereof.

Since it is desirable that the gas generant composition be essentially smokeless only a relatively small amount of oxidizer should be included in the gas generant composition to raise the equivalence ratio or to increase the burning rate. In accordance with certain preferred embodiments of the invention, an oxidizer may be added in amount up to about 20 composition weight percent. Advantageously, such oxidizer is included in the gas generant in an amount effective to result in an equivalence ratio of about 0.6 to about 1.0.

If desired, a gas generant composition in accordance with the invention may advantageously contain or include an coolant. Such a coolant may be added to reduce the burning rate of the gas generant composition. In practice, the gas generants of the present invention may include a coolant in the range of up to about 20 composition weight percent. Suitable coolants include, but are not limited to, oxalic acid, ammonium oxalate, oxamide, ammonium carbonate, calcium carbonate, magnesium carbonate, and combinations thereof.

The gas generant compositions of the present invention may be made by combining the binder matrix components, the fuel, the stabilizer and any optional components such as oxidizers or coolants with a solvent to form a viscous paste. The paste may then be extruded and cut to form cylindrical pellets, grains or extrudlets. The use of the dimethyl malonate plasticizer reduces the amount of solvent required for extrusion and minimizes the dimensional changes which occur during the drying of the wet extrudlets. Solvents suitable for use in the preparation of such gas generant extrudlets include alcohols, ketones, ethyl acetate, butyl acetate, and combinations thereof.

The present invention is described in further detail in connection with the following example which illustrates or simulates various aspects involved in the practice of the invention. It is to be understood that all changes that come within the spirit of the invention are desired to be protected and thus the invention is not to be construed as limited by this example.

EXAMPLE

A gas generant having the following composition was prepared:

| Ingredient | Percent (Wt.) |
|---|---|
| RDX | 80.00 |
| Cellulose acetate | 13.18 |
| Dimethyl malonate | 6.49 |
| N-methyl-p-nitroaniline | 0.33 |
| Total | 100.00 |

The softening temperature of this composition exceeds 150° C. Thermogravimetric analysis of this composition showed that no dimethyl malonate is lost from the composition at temperatures below 150° C. Bottle aging of this composition at 1070° for 400 hours showed that individual extrudlets did not stick together.

The invention illustratively disclosed herein suitably may be practiced in the absence of any element, part, step, component, or ingredient which is not specifically disclosed herein.

While in the foregoing detailed description this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

What is claimed is:

1. A binder matrix comprising:

a non-energetic binder material; and a non-energetic plasticizer, wherein the non-energetic plasticizer is dimethyl malonate, and the binder matrix has a softening temperature above at least about 125° C.

2. The binder matrix of claim 1 wherein the non-energetic binder material comprises cellulose acetate.

3. The binder matrix of claim 2 wherein the binder matrix comprises about 35 to about 45 matrix weight percent cellulose acetate.

4. The binder matrix of claim 2 wherein the binder matrix comprises about 55 to about 65 matrix weight percent dimethyl malonate.

5. A gas generant composition comprising:

the binder matrix of claim 1;

a fuel; and a stabilizer.

6. The gas generant of claim 5 wherein the non-energetic binder material comprises cellulose acetate.

7. The gas generant composition of claim 5 wherein the fuel comprises a nitramine fuel.

8. The gas generant composition of claim 7 wherein the nitramine fuel is selected from the group consisting of cyclotrimethylenetrinitramine, cyclotetramethylenetetranitramine, and combinations thereof.

9. The gas generant composition of claim 5 wherein the stabilizer comprises N-methyl-p-nitroaniline.

10. The gas generant composition of claim 5 comprising:

about 8 to about 15 composition weight percent non-energetic binder material;

about 5 to about 12 composition weight percent dimethyl malonate;

about 70 to about 85 composition weight percent fuel; and about 0.2 to about 0.5 composition weight percent stabilizer.

11. A gas generant composition comprising:

a binder matrix including about 8 to about 15 composition weight percent cellulose acetate binder material and about 5 to about 12 composition weight percent dimethyl malonate plasticizer;

about 70 to about 85 composition weight percent nitramine fuel; and about 0.2 to about 0.5 composition weight percent N-methyl-p-nitroaniline stabilizer, wherein the binder matrix has a softening temperature above at least about 125° C.

12. The gas generant composition of claim 11 wherein the nitramine fuel is selected from the group consisting of cyclotrimethylenetrinitramine, cyclotetramethylenetetranitramine, and combinations thereof.

13. The gas generant composition of claim 11 further comprising an oxidizer in an amount up to about 20 composition weight percent.

14. The gas generant composition of claim 13 wherein the oxidizer is present in an amount effective to result in an equivalence ratio of about 0.6 to about 1.0.

15. The gas generant composition of claim 11 further comprising a coolant in an amount up to about 20 composition weight percent.

16. A method for inflating an airbag cushion of an inflatable restraint system of a motor vehicle comprising the steps of:

igniting a gas generant composition with an ignition means to produce a quantity of inflation gas; and inflating the airbag cushion with the inflation gas, wherein the gas generant composition includes a fuel, a stabilizer, and a binder matrix having a softening temperature above at least about 125° C., the binder matrix including non-energetic binder material and dimethyl malonate plasticizer.

17. The method of claim 16 further comprising the steps of:

providing an oxygen-containing gas; and igniting the gas generant composition in the presence of the oxygen-containing gas to produce an additional quantity of inflation gas.

18. The method of claim 17 wherein the oxygen-containing gas comprises nitrous oxide.

19. The method of claim 17 wherein the oxygen-containing gas comprises oxygen.

20. The method of claim 17 wherein the oxygen-containing gas comprises an inert gas selected from the group consisting of argon, helium and combinations thereof.

21. The method of claim 16 wherein the gas generant composition comprises:

about 8 to about 15 composition weight percent cellulose acetate binder material;

about 5 to about 12 composition weight percent dimethyl malonate plasticizer;

about 70 to about 85 composition weight percent fuel selected from the group consisting of cyclotrimethylenetrinitramine, cyclotetramethylenetetranitramine, and combinations thereof; and about 0.2 to about 0.5 composition weight percent N-methyl-p-nitroaniline stabilizer.

* * * * *